United States Patent [19]

Strong

[11] 4,015,502

[45] Apr. 5, 1977

[54] PICK FOR STRING INSTRUMENTS

[76] Inventor: Jack C. Strong, P.O. Box 251, Brightwood, Oreg. 97011

[22] Filed: May 24, 1976

[21] Appl. No.: 689,137

Related U.S. Application Data

[63] Continuation-in-part of Ser. No. 563,336, May 5, 1975, abandoned.

[52] U.S. Cl. ..... 84/322

[51] Int. Cl.[2] ..... G10D 3/16

[58] Field of Search ..... 84/322

[56] References Cited

UNITED STATES PATENTS

| | | | |
|---|---|---|---|
| 995,108 | 6/1911 | Aspegren | 84/322 |
| 1,690,860 | 11/1928 | Gonzalez | 84/322 |
| 3,648,558 | 3/1972 | Chenette | 84/322 |

*Primary Examiner*—Lawrence R. Franklin
*Attorney, Agent, or Firm*—Eugene M. Eckelman

[57] ABSTRACT

A body member formed of a length of wire-like material has side extensions arranged to engage longitudinally the under portion of a finger adjacent each side. The body member has a front projecting portion comprising a string picking head, and a flexible strap is secured at opposite ends thereof to the side extensions of the body member for holding the pick on a musician's finger. The strap is adjustable in length to adjust to different size fingers and is also adjustable longitudinally along the side extensions. The body member preferably has the characteristics of spring steel wire whereby to be sufficiently rigid for picking but at the same time is bendable into selected shapes to provide various picking head arrangements and also to be made to conform to the contour of a musician's finger. The picking head may have a resilient picking surface for tone quality.

8 Claims, 9 Drawing Figures

PICK FOR STRING INSTRUMENTS

REFERENCE TO PRIOR APPLICATIONS

This application comprises a continuation-in part-of application Ser. No. 563,336, filed May 5, 1975, for GUITAR PICKS, now abandoned.

BACKGROUND OF THE INVENTION

This invention relates to new and useful improvements in picks for string instruments. Picks have heretofore been provided which are ring-like and adapted to be pushed on a finger of a musician for playing guitars or other string instruments. The most commonly used type of finger pick comprises a split body member, plastic or metal, which is held on the finger by a rather strong clamping engagement with the finger. Still other types of picks have been provided which attach to the fingers but in general it has been found that these picks are not only uncomfortable to wear and sometimes even shut off the flow of blood but in addition are not secured on the finger in a manner to provide good picking functions by the musician, particularly to and fro picking functions. Another disadvantage of prior picks is that the picking head is made of metal or hard plastic and a harsh tone results on the strings, particularly on wound strings. A further disadvantage of prior picks is that they are too bulky to use on adjacent fingers.

SUMMARY OF THE INVENTION

According to the present invention and forming a primary objective thereof, a pick construction is provided which overcomes the deficiencies of prior structures and more particularly includes features wherein it is securely mounted to the finger for to-and-fro picking, is comfortable to wear over long periods of time, is not bulky so that a pick can be attached on each of adjacent fingers, and may have a resilient picking head to eliminate harsh tones.

To carry out these objectives, a body member is formed of a length of wire-like material and has a pair of side portions arranged to engage longitudinally the under portion of a musician's finger adjacent each side. Such body member has a front projecting portion leading from said side portions and formed into a string picking head which may have a resilient picking surface. A flexible strap is arranged to extend laterally over the top and down the sides of the finger and has opposite end portions adjustably attached to the body member. The body member is formed of a bendable wire having the characteristics of spring steel and may be formed as desired to shape the picking head and also to shape a rearward portion thereof longitudinally to the musician's finger.

Another object of the present invention is to provide a pick for string instruments which is simplified in construction and inexpensive to manufacture.

The invention will be better understood and additional objects and advantages will become apparent from the following description taken in conjunction with the accompanying drawings.

DETAILED DESCRIPTION OF THE PREFERRED EMBODIMENTS

Figure 1:
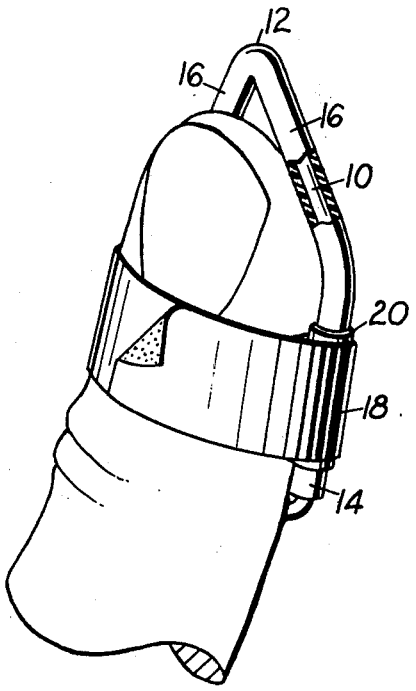
FIG. 1 is a perspective view of a first form of pick embodying my invention, the pick being shown applied to a musician's finger.
Figure 2:
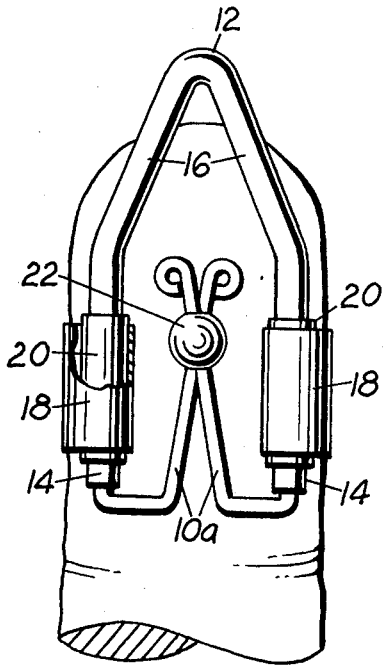
FIG. 2 is an elevational view of the pick taken from the underside of the finger.

With reference first to FIGS. 1 and 2 which show a first form of the pick, the structure includes a body member 10 which comprise spring steel wire or any other material having the characteristics of spring steel wire wherein it has sufficient rigidity to be attached longitudinally to a musician's finger and capable of applying a picking function, and furthermore it can be bent so that it can be formed into selected shapes and contours as will be more apparent hereinafter. The body member 10 has a resilient covering 12 and has side extensions or bar portions 14 extending rearwardly for engaging the finger. The forward end of the body member terminates in a picking head 16 comprising merely a reversely turned portion of said body member. The resilient covering 12 may comprise rubber or any suitable plastic material having tough, resilient qualities, such as vinyl, Teflon, etc.

The body member 10 is held on the finger by a laterally extending flexible strap 18, and such strap has opposite ends attached to short tubular members 20 frictionally fitted on covering 12 of the body member. It is preferred that the tubular members 20 have a rather tight frictional fit on the body member for holding the body member in place but at the same time are adjustable by forced movement therealong in order that the body member can be adjusted longitudinally relative to the finger. The strap 18 can be formed of a tape having an adhesive on one surface thereof and can be wrapped around the tubular members 20 so as to be custom fitted to a particular musician's finger. An example of such strap is one-half inch wide cloth based Mystic tape or one-half inch Scotch Magic Transparent Tape. Such custom fitting on the finger may be achieved by fixing the strap to one side, pulling the free end of the strap around the opposite tube, and then with the finger in place the strap can be trimmed to the desired length. The rearward ends 10*a* of the body 10 are directed inwardly toward each other and then bent forwardly. These two ends are crossed and receive a sliding fastener 22 such as an apertured bead which when slid toward the end of the finger loosens the pick on the finger but when slid rearwardly of the finger draws in the two side extensions of the pick to tighten it on the finger. The bead may be positioned selectively along the length of the ends 10*a* to accomplish the desired tightness on the finger. In the mounted position of the pick on the finger as shown in FIGS. 1 and 2, the side extensions 14 extend longitudinally of the finger and engage the undersurface adjacent opposite sides. The strap extends laterally over the top and down the sides and holds the pick firmly on the finger for efficient picking in to and fro directions.

Figure 3:
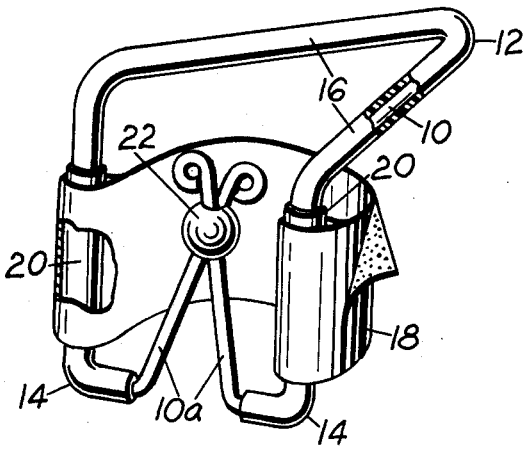
FIG. 3 is a perspective view of the pick shown by itself and being shaped slightly different from that shown in FIGS. 1 and 2 for application to the thumb.

FIG. 3 shows structure similar to that in FIGS. 1 and 2 except that the picking head 16 assumes a shape for use as a thumb pick. Since the body member 10 is formed of a bendable material, and since the tubular members 20 are adjustable lengthwise on the body member, the shaping of the head can be made by the musician to be used on the desired finger. Although different views in this application show the pick applied to both a finger and a thumb, the term "finger" herein is meant to designate the five fingers including the thumb.

FIGS. 4 through 8 show a slightly modified form of the present pick. As in the first embodiment, the body member 10′ is provided with a resilient covering 12′ and has side extensions or bars 14′ which extend longitudinally rearwardly on the finger. This embodiment is similarly held on the finger by a laterally extending strap 18′ engageable with tubular members 20′ fitted frictionally on the side extensions. The rearward extensions 10*a*′ of the body member 10′ in this embodiment have a laterally extending hook 24 on one of the extensions releasably engageable with an eye 26 on the other extension. While this type of fastening does not have the adjustable feature of the first embodiment, suitable adjustment to fit the finger can be accomplished by selected bending of the body member at the rear thereof and also by selected attachment of the strap 18′.

Figure 4:
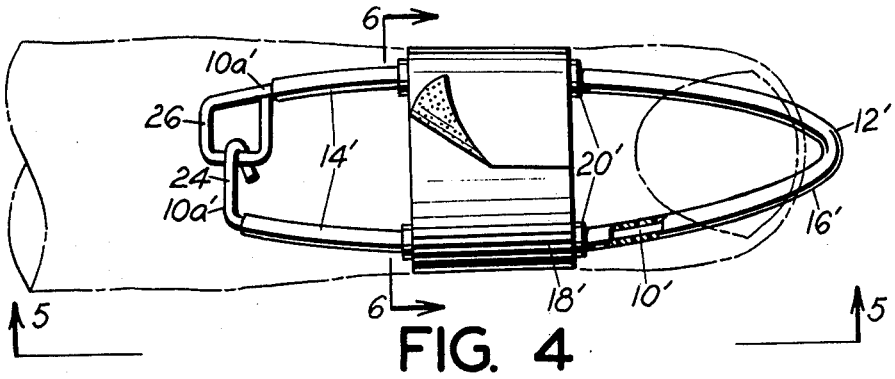
FIG. 4 is a top plan view of a second form of pick embodying my invention, a musician's finger being shown in this view in broken lines.
Figure 5:
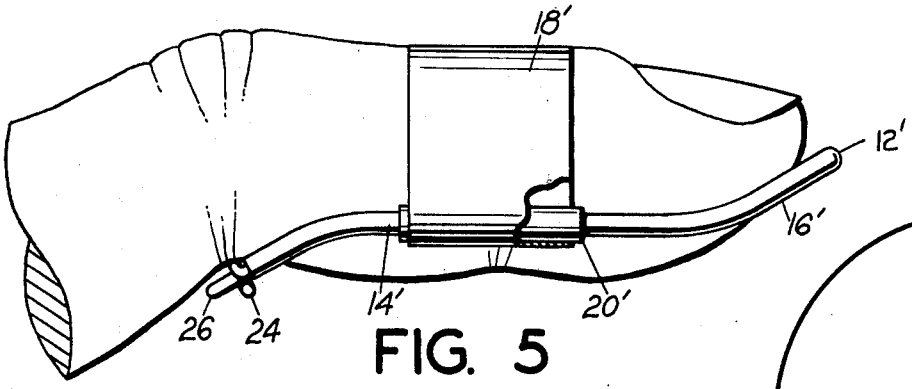
FIG. 5 is a side elevational view of the pick of FIG. 4 as applied to a musician's finger.
Figure 6:
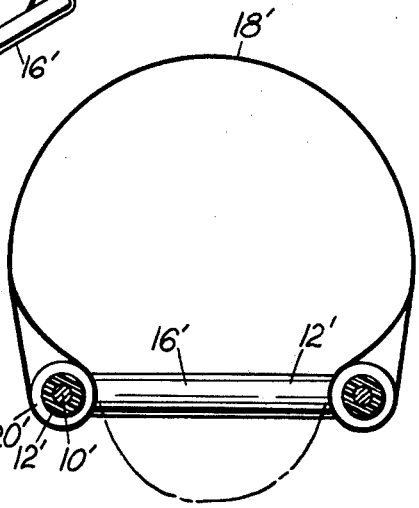
FIG. 6 is a sectional view taken on the line 6—6 of FIG. 4.

The embodiments of FIGS. 4, 5, and 6, 7 add the feature over the first embodiment that the rearward portions of the side extensions 14′ are elongated whereby to have elongated surface engagement with the under side of the finger. That is, in the embodiment of FIGS. 4 and 5, the side extensions 14′ extend rearwardly beyond the first knuckle of the finger so as also to have firm engagement with the fleshy portion of the finger behind the first knuckle. In addition, this portion is bent downwardly in order to be disposed under the second knuckle in the normal picking position of the finger which, as shown in FIG. 5, comprises a slightly bent position. The forward end of the pick will generally be bent upwardly as shown in FIG. 5 for best picking functions, and thus such contouring of the pick at its forward and rearward portions is readily accomplished by the musician for best fitting to the finger and for best picking. FIG. 6 is a transverse sectional view showing the finger in broken lines and also showing how the gripping effect of the pick presses into the flesh of the finger to provide a firm but comfortable engagement of the pick on the finger.

Figure 7:
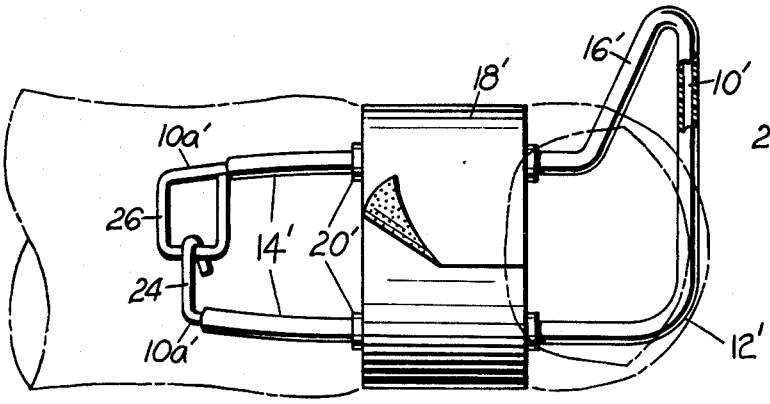
FIG. 7 is a top plan view of the pick as formed in a different shape from that of FIG. 3 for application to the thumb, a thumb being shown in this view in broken lines.
Figure 8:
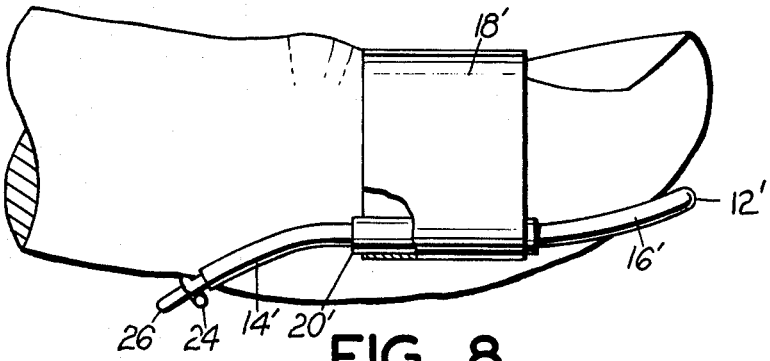
FIG. 8 is a side elevational view of the pick of FIG. 7.

The structure of FIGS. 7 and 8 is the same as FIGS. 4 and 5 except that the picking head is shaped for a thumb pick and the rearward portion of the side extension is a little shorter so as to engage the fleshy portion of the thumb mostly in the area of the first knuckle of the thumb whereby to have good engagement with the thumb in the normal picking shape of the latter which is slightly reversely arched.

Figure 9:
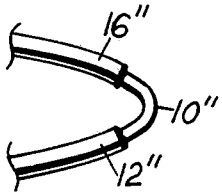
FIG. 9 is a fragmentary plan view of a modified form of picking head capable of use with all embodiments.

FIG. 9 shows a modified form of the picking head 16″ wherein the covering 12″ is cut away to expose the wire 10″. Such embodiment shows the versatility of the present pick in that if the musician desires to utilize a metal picking surface, he can merely cut away or shave off the end of the covering 12″, or if desired a pick can be manufactured with the picking surface already cut away.

According to the present invention, a pick is provided which is simplified in construction and can be worn for long periods of time without any discomfort. It is adjustable by means of the holding strap to fit different sizes and shapes of fingers and furthermore its form can be adjusted by bending the body member to produce the shape desired for engagement with the finger and for shaping the picking head. The pick is not bulky in its construction and thus picks can be attached to adjacent fingers without interfering with each other. It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. A pick for string instruments comprising
   a. a body member formed of a length of wire-like material,
   b. said body member having a pair of side portions arranged to engage longitudinally the under portion of a finger adjacent each side,
   c. said body member also having a front projecting portion leading from said side portions formed into a string picking head,
   d. and a strap arranged to extend laterally over the top and down the sides of a musician's finger,
   e. said strap having opposite end portions attached to respective side portions of said body member for holding said body member firmly on the finger for picking,
   f. said strap being flexible for contoured fitting over the musician's finger.

2. The pick of claim 1 wherein said strap at least at one of its attached ends to said body member being adjustable in length to adjust to different size fingers.

3. The pick of claim 1 wherein said body member comprises bendable wire having the characteristics of spring steel whereby said projecting portion is bendable into selected shapes.

4. The pick of claim 1 wherein said projecting portion has a resilient picking surface.

5. The pick of claim 1 wherein the attachment of said end portion to said body member comprises a slidable attachment whereby to adjust said strap along said body member.

6. The pick of claim 1 wherein said body member is of a length to project rearwardly of said strap and arranged to engage the finger rearwardly beyond the first knuckle for reinforced attachment of the pick on the finger.

7. The pick of claim 6 wherein said front picking portion is bent upwardly and a rearward portion of said body member is bent downwardly to conform to the shape of a finger when the latter is bent.

8. A pick for string instruments comprising
   a. a body member formed of a length of wire-like material,
   b. said body member having a pair of said portions arranged to engage longitudinally the under portion of a finger adjacent each side,
   c. said body member also having a front projecting portion leading from said side portions formed into a string picking head,
   d. said picking head having a resilient picking surface,
   e. and means on said body member arranged to attach it to a musician's finger.

* * * * *